United States Patent [19]

de Polo

[11] 4,301,546

[45] Nov. 24, 1981

[54] PANTS-TYPE GARMENTS AND METHOD OF MAKING SAME

[76] Inventor: Harry R. de Polo, 480 Park Ave., New York, N.Y. 10021

[21] Appl. No.: 176,522

[22] Filed: Aug. 8, 1980

Related U.S. Application Data

[63] Continuation-in-part of Ser. No. 54,478, Jul. 3, 1979, Pat. No. 4,240,158.

[51] Int. Cl.[3] ..... A41D 1/06; A41D 17/02

[52] U.S. Cl. ..... 2/227; 2/243 B

[58] Field of Search ..... 2/227, 228, 238, 243

[56] References Cited

U.S. PATENT DOCUMENTS 2,703,404 3/1955 Lawson ..... 2/227

3,143,741 8/1964 Tyroler ..... 2/227

*Primary Examiner*—Doris L. Troutman

*Attorney, Agent, or Firm*—Robert E. Burns; Emmanuel J. Lobato; Bruce L. Adams

[57] ABSTRACT

A pants-type garment comprises two bands of material, one for each leg, and a side extension piece which extends at an angle from one side of an upper portion of each band. Each of the bands together with its side extension piece is wound helically and adjacent edges of successive convolutions are joined in a helical junction line to form a leg and associated body portion of the garment. The two body portions are then joined to form the garment. To provide greater fullness, a V-shaped crotch band is joined to upper edge portions of each band and respective side extension piece and the two crotch bands are then joined along a central junction line. The V-shaped crotch band may be used without the side extension pieces and may be used in pants-type garments having legs and associated body portions formed of panels with vertical rather than helical seams.

15 Claims, 12 Drawing Figures

B3
B2
B1
A
1a
1b
1c
1d
1
2
2a
2b
2c
3
3a
3b
3c
3d
4
4a
4b
4c
K
K1
C
C1
D
E
F
B 7
8
L
K1
C1
D1
E
H
J
A
8a
8b
10
10a
10b
G
I
B
8d
8c
K
9
9a
9b
C
7a
7b
7c
7d
AB

PANTS-TYPE GARMENTS AND METHOD OF MAKING SAME

REFERENCE TO PRIOR APPLICATION

This application is a continuation-in-part of my application Ser. No. 054,478 filed July 3, 1979 now U.S. Pat. No. 4,240,158 and is directed to the further improvement of the invention disclosed in my U.S. Pat. No. 4,097,933.

FIELD OF INVENTION

The present invention relates to the construction of pants-type garments. The term "pants-type garment" is used broadly to include pants, slacks, jeans, shorts, culottes, overalls, coveralls and similar garments which have a body portion covering at least the lower portion of the torso and leg portions individually covering at least portions of the legs of a wearer. The present invention is applicable to garments of all sizes for men, women, children and infants.

BACKGROUND OF THE INVENTION

In U.S. Pat. No. 4,097,933 there are disclosed pants-type garments formed by bands of material which are wound helically and have adjacent edges of successive convolutions joined along helical junction lines to form the legs of the garment, upper portions of the bands being cut and joined along a central junction line to form a body portion of the garment. A garment of this construction represents an important improvement of earlier pants-type garments made by using patterns to cut pieces of various sizes and shapes from fabric material which are then sewn together to form the garment.

In application Ser. No. 054,478 now U.S. Pat. No. 4,240,158 there are disclosed pants-type garments which are of a construction similar to those of U.S. Pat. No. 4,097,933 but which have a crotch band which has one side edge joined with a contoured upper edge of one leg portion of the garment and the opposite side edge joined with a contoured edge of the other leg portion so as to unite the two leg portions and thereby form a body portion of the garment. The crotch band extends from the waist line at the back of the garment under the crotch and up to the waist line at the front of the garment. The crotch band provides a garment which has a better fit and is more comfortable to wear by virtue of the greater room provided in the crotch portion of the garment. The crotch band construction as disclosed in application Ser. No. 054,478 is also applicable to pants-type garments which are otherwise of conventional construction with two panels of material each comprising a lower leg-forming portion and an upper body-forming portion.

SUMMARY OF THE INVENTION

The present invention is directed to an improvement of pants-type garments of the construction disclosed in U.S. Pat. No. 4,097,933 and application Ser. No. 054,478. In accordance with one aspect of the present invention, a side extension piece of material having an outer side edge, an upper edge and an inner side edge having an inclined lower portion is joined to one side of an upper portion of each of the leg-forming bands of material so as to form an inclined lateral extension of the band. Upper portions of the band and respective side extension piece are contoured to provide a waist line and crotch construction. The two leg portions are then joined along a central junction line to form the body portion of the garment. The side extension pieces provide greater fullness and accommodate larger waist dimensions.

In accordance with another aspect of the present invention, each of the leg portions is formed at its upper edge with spaced portions shaped to form the waist of a garment and a reentrant intermediate portion shaped for construction of a crotch. The outer edge of a V-shaped crotch band is then joined with the reentrant edge portion at the upper end of each of the leg portions and inner edge portions of the two crotch bands are joined along a central junction line to provide a body portion joining the two legs. The V-shaped crotch band is preferably formed of two strips of material joined end-to-end at an angle to one another. The reentrant intermediate portion of the upper edge of each leg is preferably V-shaped with an included angle which is less than the angle of the V-shaped crotch band so that when the panel forming the leg and associated portion of the body is laid flat on a plane surface, the opposite sides of the "V" of the crotch band are forced toward one another so as to cause a central portion of the crotch band to be displaced upwardly from the plane surface. The crotch band construction in accordance with the present invention has been found to give greater fullness and comfort.

The improved crotch band construction in accordance with the present invention can be used with or without side extension pieces on the bands forming the legs and body portions of the garment. Moreover, the improved crotch band construction is also applicable to pants-type garments which are otherwise of conventional construction with two panels of material each comprising a lower leg-forming portion and an upper body-forming portion with edges of the panels joined by vertical rather than helical seams.

BRIEF DESCRIPTION OF DRAWINGS

The nature, object and advantages of the invention will be more fully understood from the following description of preferred embodiments illustrated by way of example in the accompanying drawings in which.

DESCRIPTION OF PREFERRED EMBODIMENTS

Figures 1, 2, 3, 4:
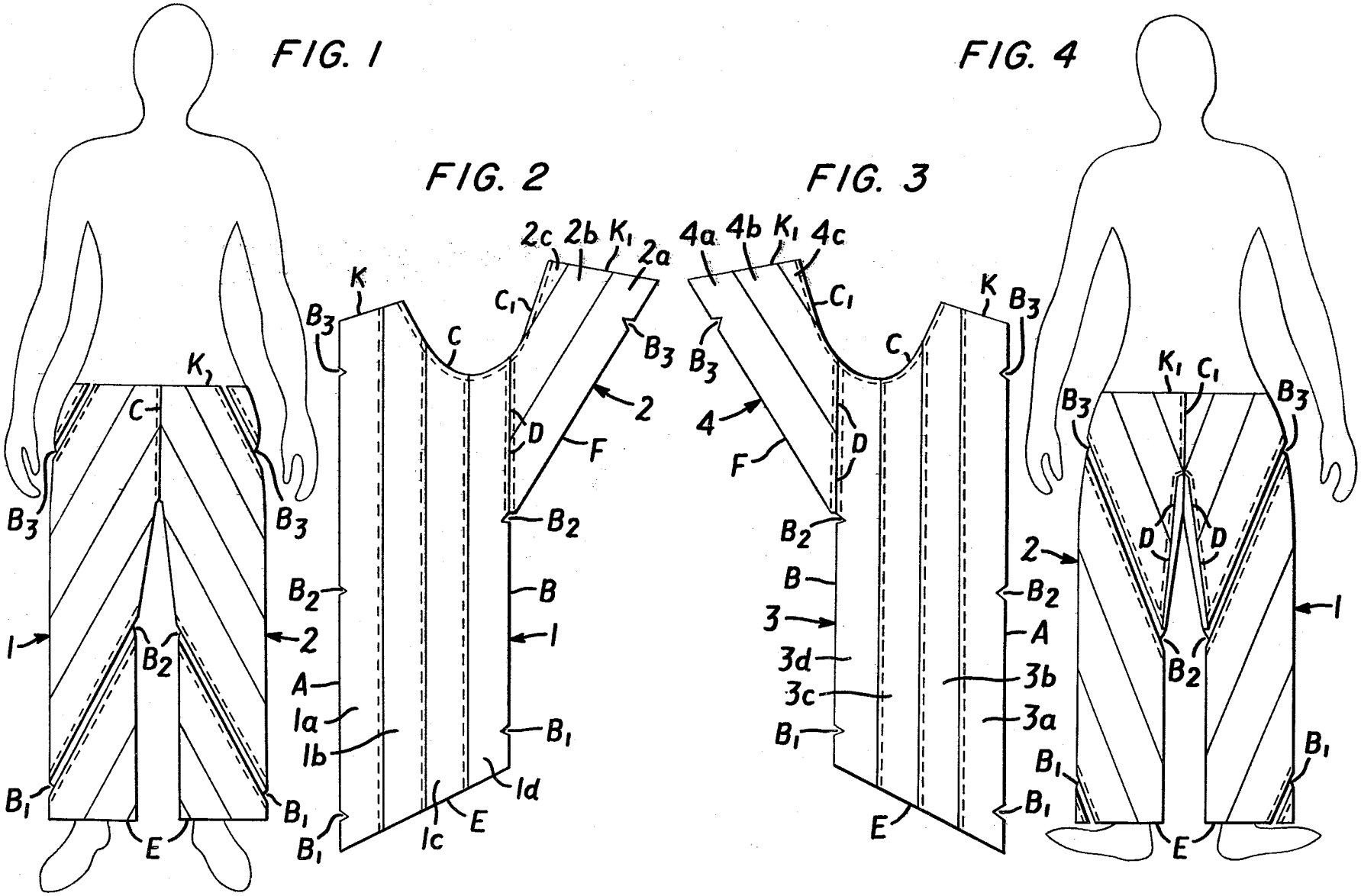
FIG. 1 is a front view of a pants-type garment in accordance with the present invention.
FIG. 2 shows the material of which the right leg of the garment shown in FIG. 1 is formed.
FIG. 3 shows the material for the left leg.
FIG. 4 is a rear view of the garment.

In the accompanying drawings, FIGS. 1 and 4 are respectively front and rear views of a pants-type garment made in accordance with the present invention. FIGS. 2 and 3 show the material from which the garment is made, FIG. 2 showing the material for the right leg of the garment and FIG. 3 showing the material for the left leg. Upper portions of the material shown in FIGS. 2 and 3 form a body portion of the garment when the two legs are assembled as illustrated in FIGS. 1 and 4.

The material for the right leg of the garment is shown in FIG. 2 as comprising an elongated band 1 and a side extension piece 2. The band 1 is shown as having two parallel side edges A and B, an inclined lower edge E and a contoured upper edge comprising an inclined portion K which is approximately parallel to the lower edge E and a curved portion C. The band 1 is shown as being made up of a plurality of strips of material 1*a*, 1*b*, 1*c*, 1*d* which are joined with one another by parallel seams.

The side extension piece 2 is shown as having an outer side edge F, an inner side edge having an upper portion $C_1$ and an inclined lower portion D and an upper end edge $K_1$. The inclined side edge D of the side extension piece 2 is shown joined to an upper portion of the side edge B of the band 1, for example by a seam, so that the side extension piece 2 extends laterally at an angle from the upper portion of the band 1. Moreover, it will be seen that the outer side edge F of the side extension piece 2 forms an angular extension of the side edge B of the band 1 while the upper portion $C_1$ of the inner side edge forms an extension of the edge C of the band. The side extension piece 2 is shown by way of example as being made up of two strips of material 2*a* and 2*b* and a smaller triangular piece 2*c* joined by parallel seams.

The material for the left leg is shown in FIG. 3 as comprising an elongated band 3 and a side extension piece 4. It will be seen that the material for the left leg is the same as that for the right leg except for being reversed. Thus the band 3 is shown as being composed of four strips 3*a*, 3*b*, 3*c*, 3*d* and having parallel side edges A and B, an inclined lower edge E and a contoured upper edge C, K. Likewise, the side extension piece 4 is shown as being composed of two strips 4*a*, 4*b* and a triangular piece 4*c* and having an outer side edge F, an upper edge $K_1$ and inner side edge having an upper portion $C_1$ and an inclined lower portion D which is shown joined with an upper portion of the side edge B of the band 3 so that the side extension piece 4 extends laterally at an angle from the upper portion of the band 3.

While the bands 1 and 3 are shown as being made up of four strips of material, it will be understood that each of the bands can, if desired, be a single piece of material or can be made up of two, three or more strips or pieces. When two or more strips of material are used, the strips can be of the same width as shown by way of example in the drawings or can be of different widths. Moreover, the individual strips can be of the same material or of different material. For example the material can be of different colors or of different fabric construction. Thus one or more strips can be of elastic material or of apertured material such as lace or net. Likewise, each of the side extension pieces 2, 4 can be a single piece of material or can be made up of two or more strips or pieces. The material used for the side extension pieces 2, 4 can be different from that of the bands 1, 3 and, when the side extension pieces are made up of two or more strips or pieces of material, the individual strips or pieces can be of different material as described with respect to the bands 1, 3.

When the side extension piece 2 has been joined to the band 1 as illustrated in FIG. 2, the band together with the side extension piece is wound in a helical manner as illustrated in FIGS. 1 and 4 and the side edge A of the band 1 is joined to the free portion of the side B and to the edge F of the side extension piece 2 by a single helical seam to form the right leg and right side of the body portion of the garment. In order to illustrate the construction more clearly, the edge A is shown in FIGS. 1 and 4 as being slightly spaced from edges B and F instead of being joined. Notches $B_1$, $B_2$ and $B_3$ shown in the edges of the material in FIG. 2 are for the purpose of orienting opposite edges of the material when wound into helical form. Thus notches $B_1$, $B_2$, and $B_3$ in one edge mate respectively with notches $B_1$, $B_2$ and $B_3$ in the opposite edge of the material when wound helically. It will be seen that notch $B_2$ in the right edge is located at the junction of edge F of the side extension 2 with the edge B of band 1.

When the material shown in FIG. 2 is wound into helical form and adjacent edges of successive convolutions are joined by a helical seam as described above, the inclined edge E of the band 1 forms the lower edge of the leg as seen in FIG. 1. Such edge is suitably finished, for example by a hem or a cuff. The inclined edge K at the upper end of band 1 and the upper end edge $K_1$ of side extension piece 2 form portions of the waist of the garment while edge C of band 1 and edge $C_1$ of side extension piece 2 are joined with corresponding edges of the material for the left leg in a central junction line including the crotch of the garment.

The band 3 and side extension piece 4 which are to form the left leg and adjacent body portion of the garment are likewise wound in helical form (but in the opposite direction) and adjacent edges of successive convolutions are joined by a single helical seam as described above with respect to the right leg using notches $B_1$, $B_2$ and $B_3$ to line up successive convolutions. It will be understood that suitable marks can be used instead of notches and also that an operator may development sufficient skill to eliminate the need of markers. When the left leg has been formed in the same manner as described above with respect to the right leg, edges C, $C_1$ of the right leg are joined with edge C, $C_1$ of the left leg along a central junction line thereby uniting the two legs and forming the body portion of the garment. It will be understood that the usual fly construction can be provided in a forward portion of the junction line or that a slide fastener may be provided at the rear. Alternatively a slide fastener can be provided in an upper portion of the junction line between the edge A and the edge F, for example above the point $B_3$. The edges K and $K_1$ forming the waist of the garment are suitably finished by a waist band.

As will be seen from FIG. 1, upper portions of the junction line between edges A and F are in convenient locations for openings for front pockets. Rear pockets, for example patch pockets, can be provided on rear portions of the garment formed by side extension pieces 2 and 4. Such pockets can be provided while the material is still in flat form as shown in FIGS. 2 and 3 thereby simplifying the construction.

The side extension pieces 2 and 4 provide for construction of pants-type garments in larger sizes or with fuller cuts. It will be seen that the side extension pieces not only provide more room in the waist and seat of the garment but also that the lower point of the side extension piece at $B_2$ occurs approximately at the knee of the garment which allows for a good freedom of movement. The size of the side extension piece can be varied according to the size of the garment as can also the angle between edges D and F which determine the angle at which the side piece 2, 4 extends from the band 1, 3. It has been found that this angle should usually be within the range of 20 to 45 degrees. While the side pieces 2, 4 could be cut integrally with the bands, 1, 3, less waste of material can usually be achieved by cutting the side extension pieces separately and joining them with the bands. As the bands 1 and 3 are straight bands of uniform width, they can be cut with minimum material wastage. Likewise, the side pieces 2, 4 can be laid out on material in such manner as to keep wastage at the minimum. Thus as illustrated in FIGS. 2 and 3, the side extension pieces 2, 4 are half the width of the bands 1, 3 so that they can be cut economically from the same material—the small triangular pieces 2*c*, 4*c* being cut from "scraps"—.

While full length trousers have been shown in FIGS. 1 and 4, it will be understood that the legs of the garment can be of any desired length. Thus the construction in accordance with the present invention is equally applicable to such garments as cullottes and shorts. Likewise the garment can have an upper portion extending above the waist as in the case of overalls and coveralls.

Figures 5, 6, 7, 8:
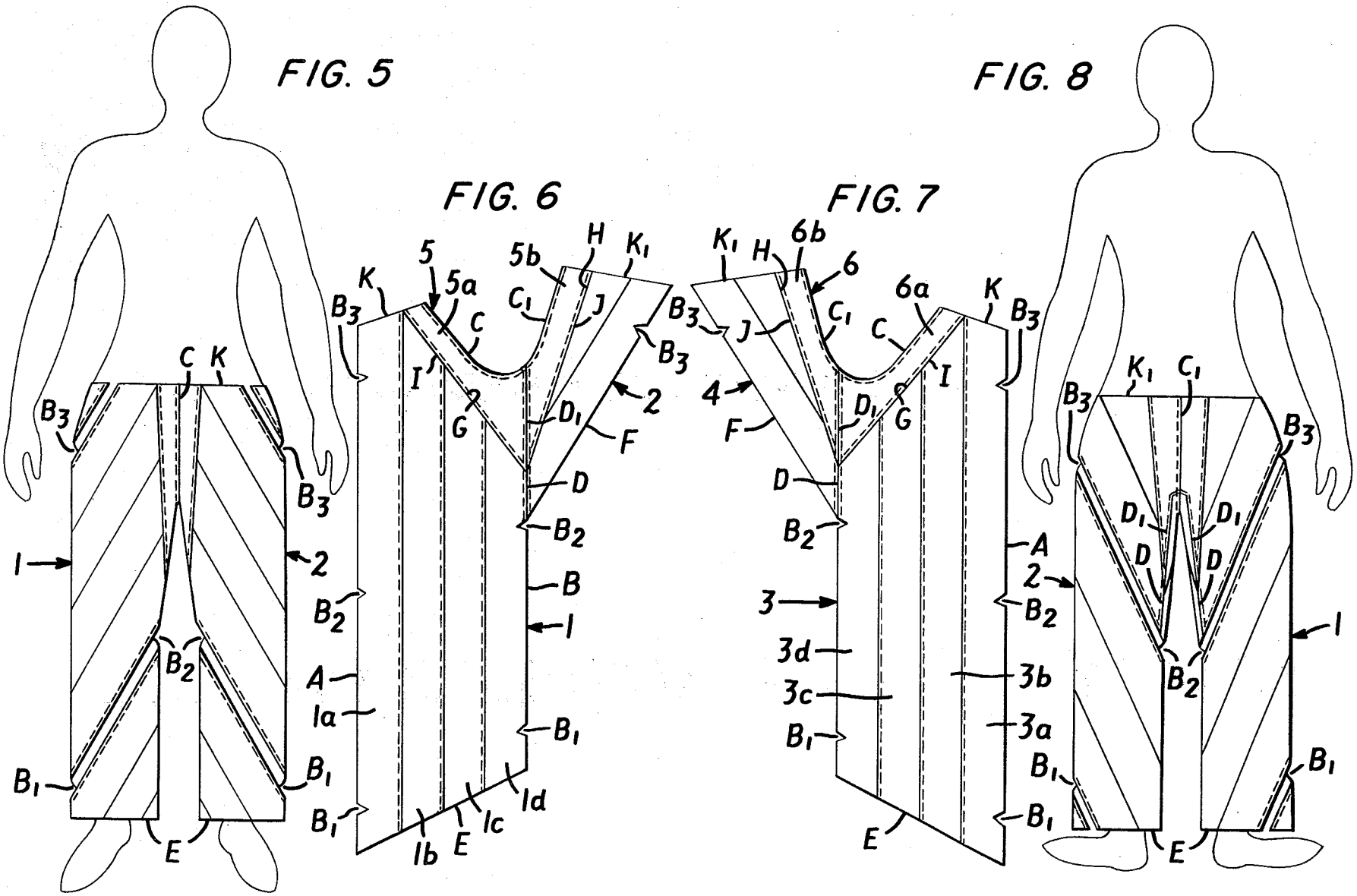
FIG. 5 is a front view of a garment similar to that of FIG. 1 but embodying a crotch band.
FIG. 6 shows the material from which the right leg of the garment of FIG. 5 is formed.
FIG. 7 shows the material for the left leg.
FIG. 8 is a rear view of the garment shown in FIG. 5.

In FIGS. 5–8 there is shown a pants-type garment which is like that shown in FIGS. 1–4 except for the incorporation of a crotch band. FIGS. 5 and 8 show the front and rear of the garment respectively while FIGS. 6 and 7 show the material for the right leg and left leg respectively. Except for the crotch band, the several parts are designated by the same reference characters as in FIGS. 1–4.

As seen in FIG. 6, the material for the right leg of the garment comprises a band 1, a side extension piece 2 and a crotch band 5. The upper edge of the material comprising the band 1 and the side extension piece 2 is contoured so as to provide spaced portions K and $K_1$ shaped to form the waist of the garment and a reentrant intermediate portion defined by edges G and H for reception of the crotch band. The crotch band is shown as being formed of two pieces of material 5*a* and 5*b* which are joined end-to-end at an angle to one another along a line $D_1$ so as to form a crotch band which is generally V-shaped. Outer edges I, J of the crotch band are joined respectively with edge G of band 1 and H of side extension piece 2, for example by seams. Whereas outer edges I, H of the crotch band are straight and meet at an acute angle to one another, the opposite inner edges C, $C_1$ are curved and are adapted to be joined with corresponding edges of the crotch band of the other leg to form the crotch of the garment.

The crotch band 5 is shaped to provide greater fullness in the crotch than would be provided by a flat piece of material fitting into the V-shaped recess formed by edges G and H of the band 1 and side extension piece 2. Thus if the material comprising the band 1 and side extension piece 2 is laid flat on a plane surface, the crotch band 5 will not lie flat but will bulge or buckle upwardly. When the crotch band is in free condition, i.e. before being joined to band 1 and side extension piece 2, the outer edges I, J of the crotch piece define an angle which is larger than the angle defined by edges G and H of band 1 and side extension piece 2 when laid flat on a plane surface. Hence, when the crotch band 5 is assembled with the band 1 and side extension piece 2, opposite sides or arms of the V-shaped crotch band are forced toward one another, thereby providing greater fullness in the crotch band. While the crotch band 5 can, if desired, be made of a single V-shaped piece of material, it is advantageous to form it of two pieces 5*a* and 5*b* as shown in order to avoid fabric wastage and provide greater opportunity for shaping the crotch band as desired.

The material shown in FIG. 7 for forming the left leg in like manner comprises a band 3, side extension piece 4 and crotch band 6 comprising two parts 6*a* and 6*b* joined end-to-end at an acute angle to one another. The material shown in FIG. 7 is thus of the same size and shape as that of FIG. 6 except that it is reversed.

When the parts have been assembled as illustrated in FIG. 6, the band 1 together with side piece 2 and crotch band 5 is wound helically as illustrated in FIGS. 5 and 8 and edge A is joined with edges B and F in a single helical seam to form the right leg and associated body portion of the garment. In like manner the band 3 together with side extension piece 4 and crotch band 6 are wound helically (in the opposite direction) to form the left leg. The edges C and $C_1$ of crotch band 5 are thereupon joined with corresponding edges of crotch band 6 so as to unite the crotch bands with one another and thereby join the two legs and form the body portion of the garment.

The crotch bands 5 and 6 can, if desired, be of different material from the bands 1, 3 and side extension pieces 2, 4. For example the crotch bands can be more elastic either by reason of being cut on a bias or being cut from more elastic material. When the crotch bands are formed of two parts as shown, the two parts can, if desired, be of different material. Except for the crotch band as described above, the pants-type garments of FIGS. 5 to 8 is the same as that of FIGS. 1–4 and is made in like manner. It is likewise subject to the same variations as have been pointed out above with respect to FIGS. 1–4.

The crotch band construction as illustrated in FIGS. 5–8 is also applicable to pants-type garments formed of helically wound bands without side extension pieces and to garments in which seams joining edges of the material forming the legs extend vertically rather than helically. The latter is illustrated in FIGS. 9–12 in which FIG. 9 is a front view of the garment and FIG. 12 is a rear view, while FIGS. 10 and 11 show the material for forming the right and left legs respectively.

Figures 9, 10, 11, 12:
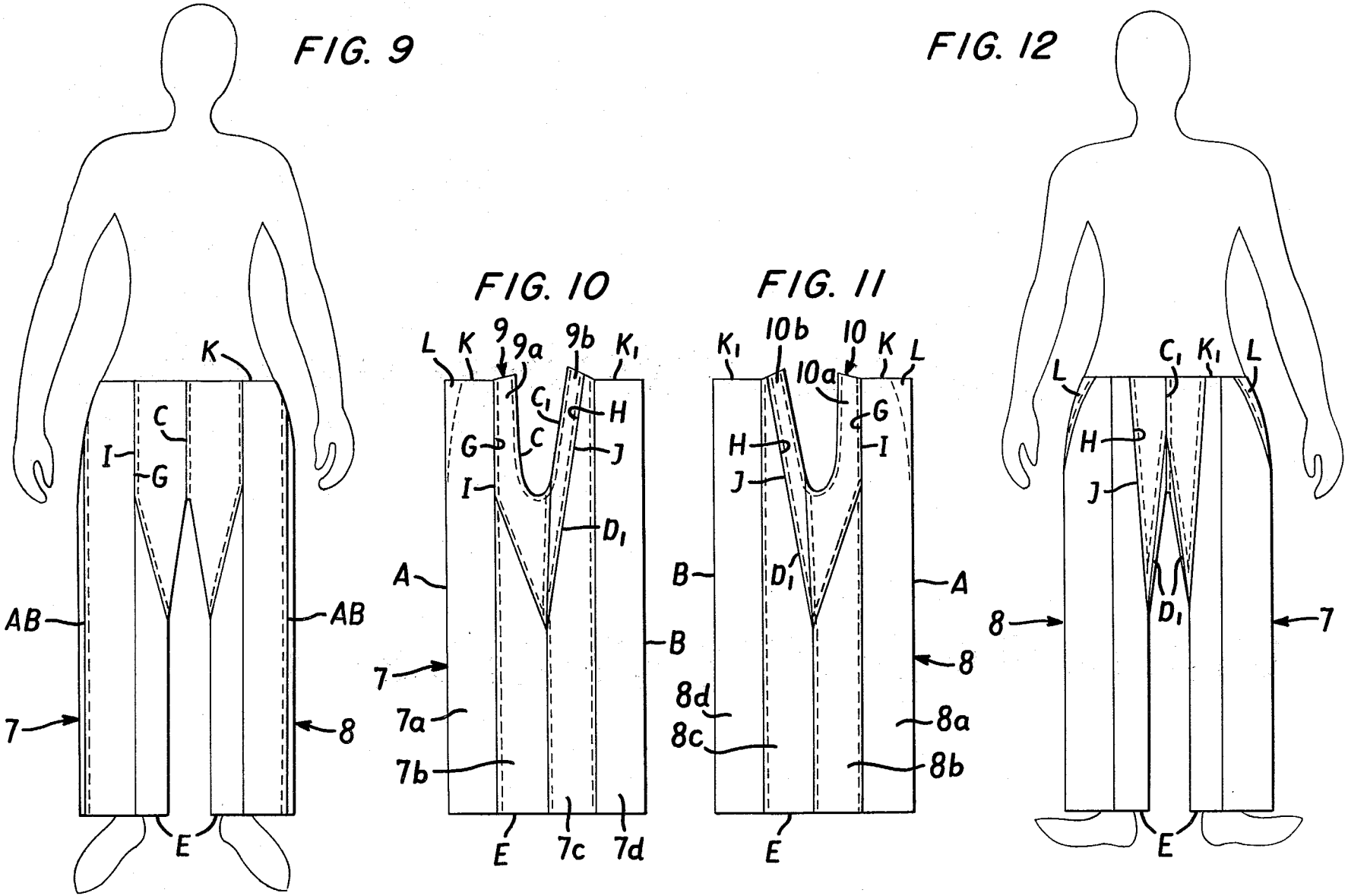
FIG. 9 is a front view of a garment similar to that of FIG. 5 but with vertical rather than helical seams.
FIG. 10 shows the material from which the right leg of the garment of FIG. 9 is formed.
FIG. 11 shows the material for the left leg.
FIG. 12 is a rear view of the garment shown in FIG. 9.

As illustrated in FIG. 10, the material for forming the right leg comprises a panel or band 7 which is shown as being made up of strips 7*a*, 7*b*, 7*c* and 7*d* joined edge-to-edge by parallel seams. The band 7 has a lower edge E which forms the lower edge of the leg and is suitably finished. The upper edge of the band 7 comprises spaced portions K and $K_1$ and a reentrant intermediate portion which is defined by edges I and J and is designed to receive a crotch band 9. The crotch band is shown as comprising two pieces 9*a* and 9*b* which are joined end-to-end at an acute angle to one another along a line $D_1$. An outer edge I of the crotch band comprises two straight portions which are joined with edge G of the band 7 while outer edge J—which meets edge I at an acute angle—joins edge H of the band 7. The inner edges C and $C_1$ are curved and are adapted to be joined with like edges of the crotch band of the other leg to unite the legs with one another.

The material shown in FIG. 11 for forming the left leg of the garment in like manner comprises a panel or band 8 composed of strips 8*a*, 8*b*, 8*c* and 8*d* joined edge-to-edge by parallel seams and a crotch band 10 made of two pieces 10*a* and 10*b*. It will be seen that the material for forming the left leg is the same as described above for forming the right leg except that it is reversed.

The foregoing description with respect to the crotch bands 5 and 6 shown in FIGS. 5–8 is applicable in like manner to the crotch bands 9, 10 shown in FIGS. 9–12. Hence, this description will not be repeated. Likewise, the description of bands 1 and 3 in FIGS. 1–8 is applicable to bands 7 and 8 of FIGS. 9–12 except for the different shape of the ends. However, if desired, the bands 7 and 8 can the crotch bands 9 and 10 can be cut so that the edges GI are symmetrical with the edges H,J. This is advantages in cutting the material in an economical manner.

After the crotch band 9 has been assembled with the band 7 as illustrated in FIG. 10, side edge A of band 7 is joined to the opposite side edge B by a single seam AB which extends vertically rather than helically to form the right leg and associated body portion of the garment. The left leg is formed in like manner from the material shown in FIG. 11. Edges C and $C_1$ of the crotch band 9 are then united with the corresponding edges of crotch band 10 to unite the two legs and form the body portion of the garment. Edges K and $K_1$ which form the waist of the garment are suitably finished, for example by a waist band. As illustrated in FIGS. 10–12, the upper portion of the garment can be shaped and the waist made somewhat smaller by tapering in the side seams as illustrated at L.

As will be seen from FIGS. 9 and 12, the crotch bands 9 and 10 extend down on the inner sides of the legs considerably below the crotch and, in fact, approximately to the knee of the garment. This provides greater fullness and greater comfort to the wearer, especially when the crotch band is made of more elastic material.

It will be understood that the various features and characteristics described with respect to each of the illustrated embodiments are applicable to other embodiments insofar as they are compatible. Moreover, still further modifications and variations are possible. For example, the material forming the legs can spiral in the direction opposite to that shown in the drawings. Thus the invention is no way limited to the illustrated embodiments.

What is claimed is:

1. In a method of making a pants-type garment having two legs, a waist and a crotch, the steps of providing first and second pieces of material each having first and second side edges, a lower edge and an upper edge, the upper edge of each of said pieces of material having spaced portions shaped to form the waist of said garment and a reentrant intermediate portion shaped for construction of a crotch, providing first and second crotch bands each of which comprises first and second crotch band pieces joined end-to-end at an acute angle to one another, joining a side edge of said first crotch band with said intermediate portion of said upper edge of said first piece of material, joining a side edge of said second crotch band with said intermediate portion of said upper edge of said second piece of material, winding said first piece of material helically and joining said second side edge with said first side edge of said first piece of material in a helical junction line to form a first leg of said garment, winding said second piece of material helically and joining said second side edge with said first side edge of said second piece of material in a helical junction line to form a second leg of said garment, and joining a free side edge of said first crotch band with a free side edge of said second crotch band to join said crotch bands and thereby join said legs with one another to form said garment.

2. A method according to claim 1, in which each of said pieces of material is formed of a band of material having first and second side edges and a side extension piece having an outer side edge, an upper end, and an inner side edge having an upper portion and a lower portion inclined to said outer side edge, the lower portion of the inner side edge of said side extension piece being joined to a side edge of said band of material so that said side extension piece extends laterally at an angle from said band of material, said first crotch band piece of said crotch band being joined with an upper edge portion of said band of material and said second crotch band piece of said crotch band being joined with an upper portion of the inner side edge of said side extension piece of the respective piece of material.

3. A method according to claim 1 or 2, in which, with said pieces of material lying flat on a plane surface and with said crotch bands joined to respective pieces of material and disposed in the general configuration of a V, the sides of said V are forced toward one another by said piece of material so that said crotch band is displaced upwardly and does not lie flat on said surface.

4. A method according to claim 1 or 2, in which edges of said first and second crotch band pieces of each crotch band which are joined with said pieces of material respectively are straight and meet at an acute angle to one another and opposite edges are curved and are joined with corresponding edges of the other crotch band to form the crotch of the garment.

5. In a method of making a pants-type garment having two legs, a waist and a crotch, the steps of providing first and second pieces of material each having first and second sides edges, a lower edge and an upper edge, the upper edge of each of said pieces of material having spaced portions shaped to form the waist of said garment and a reentrant intermediate portion shaped for construction of a crotch, providing first and second crotch bands each of which comprises first and second crotch band pieces joined end-to-end at an acute angle to one another, joining a side edge of said first crotch band with said intermediate portion of said upper edge of said first piece of material, joining a side edge of said second crotch band with said intermediate portion of said upper edge of said second piece of material, joining said second side edge with said first side edge of said first piece of material to form a first leg of said garment, joining said second side edge with said first side edge of said second piece of material to form a second leg of said garment, and joining a free side edge of said first crotch band with a free side edge of said second crotch band to join said crotch bands and thereby join said legs with one another to form said garment.

6. A method according to claim 5, in which said first and second crotch band pieces of each crotch band have straight outer side edges which meet with one another in an acute angle and are joined with said intermediate portion of the upper edge of the respective piece of material and curved inner edges which meet in a smooth curve and are joined with corresponding edges of the other crotch band to form the crotch of the garment.

7. A method according to claim 5, in which said reentrant intermediate portion of the upper edge of each of said pieces of material is of general V-configuration and said crotch band is of general V-configuration with a larger angle than said V-configuration of said intermediate portion of said upper edge of said piece of material so that when said piece of material is laid flat on a plane surface with said crotch band joined to said piece of material, opposite sides of said V-configuration of said crotch band are forced toward one another by said piece of material so that said crotch band is displaced upwardly and does not lie flat on said surface.

8. A pants-type garment comprising first and second pieces of material each having first and second side edges, a lower edge and an upper edge, the upper edge of each of said pieces of material having spaced portions shaped to form the waist of said garment and a reentrant intermediate portion shaped for construction of a crotch, first and second crotch bands each of which comprises first and second crotch band pieces joined end-to-end at an acute angle to one another to impart a generally V-shape to said crotch band, means joining an outer side edge of said first crotch band with said intermediate portion of said upper edge of said first piece of material, means joining an outer side edge of said second crotch band with said intermediate portion of said upper edge of said second piece of material, each of said pieces of material being wound helically and having edges of adjacent convolutions joined to form a leg of said garment and means joining an inner side edge of said first crotch band with an inner side edge of said second crotch band to unite said first and second crotch bands and thereby join said legs of said garment.

9. A pants-type garment according to claim 8, in which each of said pieces of material comprises a band of material having first and second side edges and a side extension piece having an outer side edge, an upper end, and an inner side edge having an upper portion and a lower portion inclined to said outer side edge, said lower portion of said inner edge of said side extension piece being joined with said first side edge of said band.

10. A pants-type garment comprising first and second pieces of material each having first and second side edges, a lower edge and an upper edge, the upper edge of each of said pieces of material having spaced portions shaped to form the waist of said garment and a reentrant intermediate portion shaped for construction of a crotch, first and second crotch bands each of which comprises first and second crotch band pieces joined end-to-end at an acute angle to one another to impart a generally V-shape to said crotch band, means joining an outer side edge of said first crotch band with said intermediate portion of said upper edge of said first piece of material, means joining an outer side edge of said second crotch band with said intermediate portion of said upper edge of said second piece of material, means joining first and second side edges of each of said pieces of material to form a leg of said garment, and means joining an inner side edge of said first crotch band with an inner side edge of said second crotch band to unite said crotch bands and thereby join said legs of said garment.

11. A pants-type garment according to claim 10, in which said crotch bands extend down to approximately knee level of said garment.

12. A pants-type garment according to claim 10, in which said crotch bands are formed of a material different from that of said first and second piece of material.

13. A pants-type garment according to claim 12, in which the material of said crotch bands is more elastic than that of said first and second pieces of material.

14. A pants-type garment according to claim 10, in which each of said first and second pieces of material is formed of a plurality of strips of material having side edges joined to one another.

15. A pants-type garment according to claim 14, in which said outer side edges of said first and second crotch band pieces converge in a junction line between two of said strips.

* * * * *